United States Patent [19]

Spiess et al.

[11] Patent Number: 4,925,337

[45] Date of Patent: May 15, 1990

[54] MANHOLE COVERING

[75] Inventors: Hansruedi Spiess, Delemont; Francois Galvanetto, Alle, both of Switzerland

[73] Assignee: Von Roll, AG, Cerlafingen, Switzerland

[21] Appl. No.: 250,344

[22] Filed: Sep. 28, 1988

[30] Foreign Application Priority Data

Oct. 12, 1987 [CH] Switzerland ..... 3974/87

[51] Int. Cl.[5] ..... E02D 29/14

[52] U.S. Cl. ..... 404/26; 404/25; 52/20; 49/463

[58] Field of Search ..... 404/25, 26; 52/19–21; 49/463; 403/8, 21, 22; 292/256, 73, 75

[56] References Cited

U.S. PATENT DOCUMENTS

| | | | |
|---|---|---|---|
| 1,136,811 | 4/1915 | Kasanszky | 403/8 |
| 3,263,579 | 8/1966 | Dorris | 404/26 |
| 3,408,778 | 11/1968 | Mason | 52/20 |

FOREIGN PATENT DOCUMENTS

| | | | |
|---|---|---|---|
| 132217 | 7/1951 | Sweden | 49/463 |
| 1249860 | 10/1971 | United Kingdom | 404/26 |

*Primary Examiner*—Stephen J. Novosad
*Assistant Examiner*—Gay Ann Spahn
*Attorney, Agent, or Firm*—Helfgott & Karas

[57] ABSTRACT

The manhole covering comprises a casing, a base frame and an adjusting device. A two-part base frame has a plurality of bores, which are aligned with pockets located in the base part of the casing. In each pocket is inserted a screw nut, into which is screwed and secured the lower end of a threaded bolt extended through the assigned bore of the base frame. The base frame is adjusted in height and slope by a pair of nuts. The adjustment of a particular slope is made possible due to the shape of the bores, which widen to either end and by convexly curved washers cooperating with the bores at their ends. The screw connection of the base frame constitutes a positive connection, which prevents breaking out of the base frame even in the case of a high, eccentric force application to the manhole covering.

5 Claims, 2 Drawing Sheets

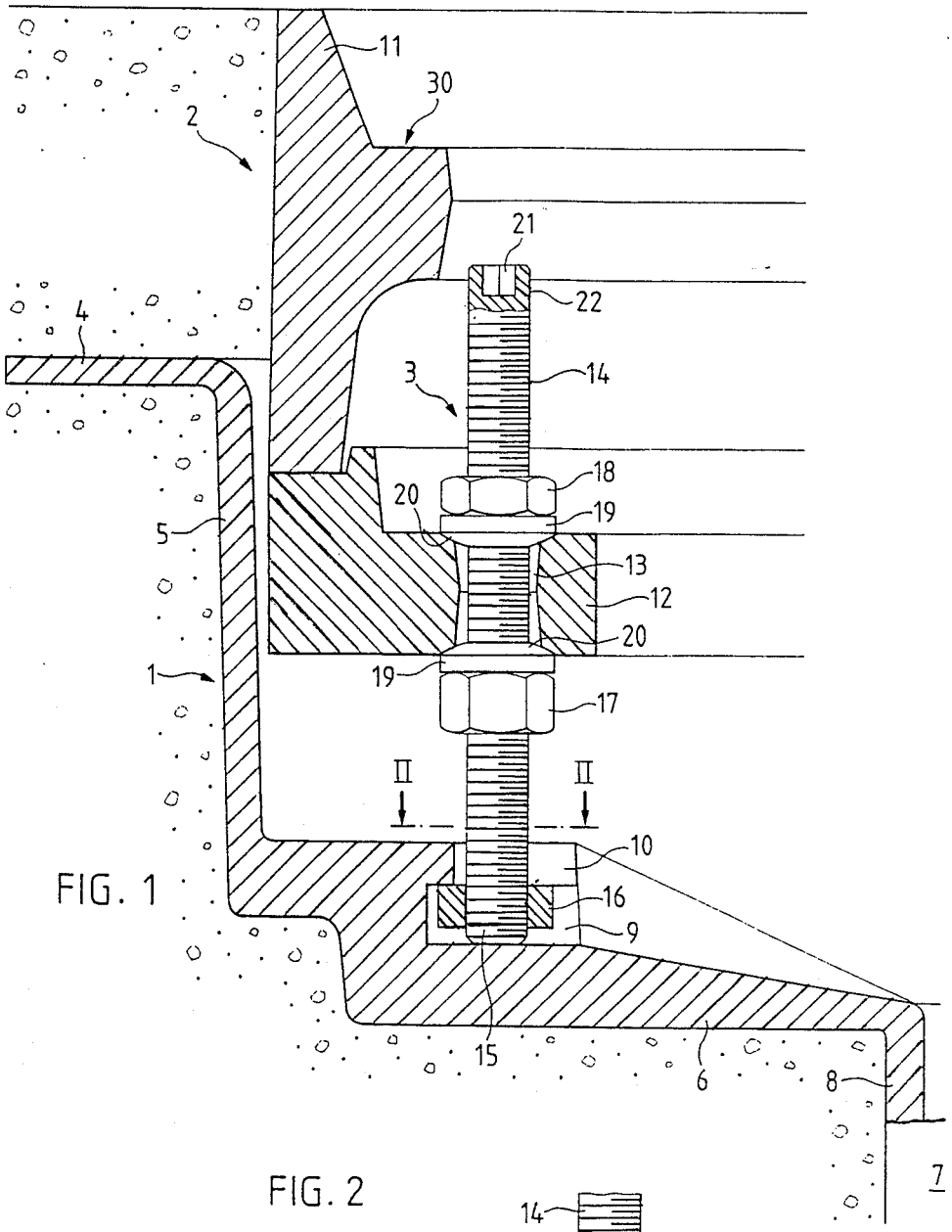
FIG. 1
FIG. 2
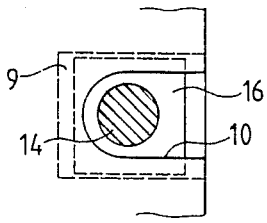
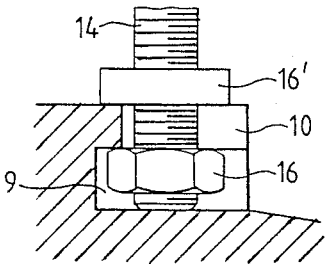
FIG. 2A

MANHOLE COVERING

BACKGROUND OF THE INVENTION

The invention relates to a manhole covering, particularly for sewers, gullies and water intakes and which is laid at the mouth of a preferably vertical manhole and has a frame or a casing embedded in the ground and a base frame for mounting a manhole cover or grating, which is provided with adjusting means enabling the adjustment in height and inclination of the base frame.

The present invention is in the field of the construction and covering of manholes, as well as the draining off of rainwater and other liquids, for constructions of all types, particularly highways, squares and bridges. The top layer is generally formed of bitumen, concrete or cement, under which there is a foundation, which can be made from different materials such as gravel, sand, concrete, etc. Between the foundation and the top layer in many cases, e.g. bridges and roadways, is provided a sealing sheet to protect the foundation from penetration of moisture.

The rainwater and other liquids falling on constructions must be drained off and, for this purpose, sewers and water intakes of various types are used. The openings of such sewers and intakes must be covered by a manhole covering, which essentially comprises a manhole frame and a manhole cover or grating inserted therein. During the first laying of such a covering the manhole frame is laid flush with the ground surface, which is necessary to permit unimpeded walking or traveling thereover.

In the case of highways and squares the problem occurs that the top layer has to be partly or completely replaced. However, it is not then generally possible to maintain the original surface level, which means that the manhole frame must be raised or lowered to the new level of the top layer. This is a complicated matter, which involves high costs and also an undesired restriction of the traffic flow. The same problem occurs in the reconstruction of roads, because in general the final level is not precisely known. The adjusting of the height and slope can also take place before or after laying the top layer. This problem has long been known and numerous proposals have already been made for reducing the effort and expenditure for a realignment of the shaft frame following the laying of a new top layer.

An important requirement in connection with such adjustable manhole frames is not only to position such a frame in different positions, but also to reliably maintain it there, so that even when heavy traffic travels over it, it cannot undergo any upward displacement. In addition, the insertion and removal of the adjusting device must be easy.

SUMMARY OF THE INVENTION

It is an object of the present invention to provide an improved manhole covering of the aforementioned type, in which not only the adjustment of the manhole frame in height is possible in simple manner, but also the slope of the frame can be easily adjusted. This and other objects is attained by a manhole covering, wherein the adjusting means include three or more threaded bolts traversing the base frame through bores of which three or more are distributed over the base frame. The threaded bolts are securely supported in the frame or casing and carry a pair of threaded nuts, which positively hold and position the base frame at the top and bottom. Thus, the base frame can be randomly adjusted in its height and slope without any need for mortaring the free space below the base frame.

It is appropriate for improving the adjustment possibility to arrange washers between the screw nuts and the base frame, which washers are provided with a convexity on the lateral face directed against the base frame. This ensures a jamming-free adjustment of a specific slope of the base frame. The adjustment of the slope is further extended if the bores for the threaded bolts in the base frame are provided with conical extensions towards both ends.

BRIEF DESCRIPTION OF THE DRAWINGS

FIG. 1 is a vertical section through a manhole covering shown schematically;

FIG. 2 is a section along line II—II in FIG. 1;

FIG. 2*a* is a partial view showing an embodiment of the adjusting arrangement.

DETAILED DESCRIPTION OF THE PREFERRED EMBODIMENTS

Figure 3:
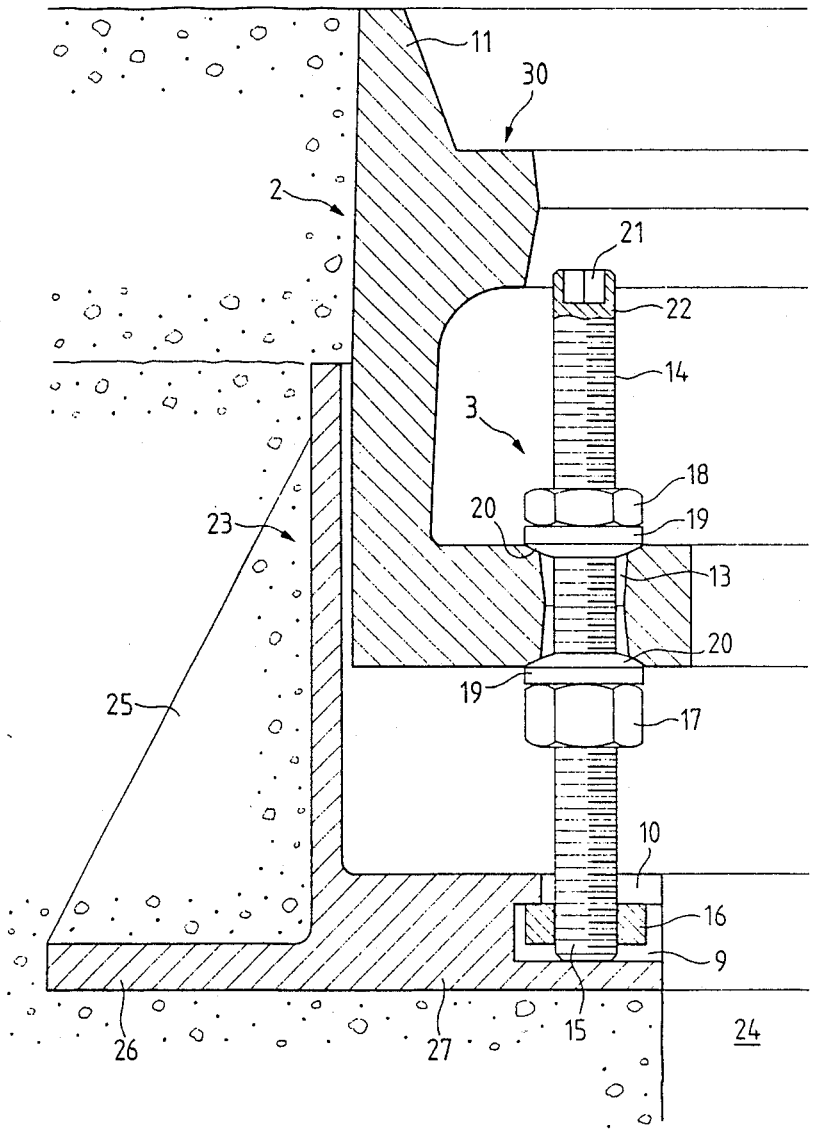
FIG. 3 is a vertical section through a manhole covering according to yet another embodiment.

The manhole covering shown in FIG. 1 comprises a casing 1, a base frame 2 insertable into the casing and adjusting means 3. Casing 1 can also have an outer flange 4, to which is connected an approximately vertical or sloping wall part 5. To the lower end of wall part 5 of the casing is connected its base part 6, in the center of which is arranged a drain 7 with a drain pipe 8. If casing 1 is used, e.g. in a bridge or on a flat roof for draining off the ground water, i.e. at a point where there is a relatively thin foundation, the drain 7 can also be provided laterally on the wall part 5 of casing 1.

Pockets 9 are provided in base part 6 in the vicinity of wall part 5 and which are partly upwardly opened at a recess 10. The pockets 9, of which there are at least three on the inner circumference of wall part 5, have a rectangular shape (FIG. 2), whilst the recess 10 is slit-like with a rounded bottom. In the vicinity of the pockets 9 the base part 6 can have a greater wall thickness, which extends over the entire inner circumference of casing 1 or may only be provided over a part of casing 1.

In FIG. 1 the base frame 2 comprises two parts, of which one part is constructed as the base frame top 11 and the other part as the base frame bottom 12. However, it is also possible to produce the base frame 2 in one piece. The subdivision into top 11 and bottom 12 takes place for practical reasons, e.g. for simplifying manufacture. The base frame top 11 and base frame bottom 12 can also be interconnected, e.g. by screwing or welding (not shown). In the base frame bottom 12 are made vertical bores 13, which can have a cylindrical shape or, as shown in FIG. 1, have a funnel shape widening to either side. The number of bores 13 coincides with the number of pockets 9 and also bores 13 and pockets 9 are aligned.

Through the bores 13 extends a threaded bolt 14, whose lower end 15 projects through the recesses 10 into pockets 9. In pockets 9 is placed a screw nut 16, whose outer contour is rectangular or square and fits, with a limited lateral clearance, in pocket 9. If the lower end 15 of threaded bolt 14 is now screwed into screw nut 16, the latter cannot rotate in pocket 9, so that it can be screwed onto the lower end 15 until it engages snugly on the top of pocket 9 and forms a firm connection with base part 6.

Onto the threaded bolt 14 is screwed a pair of screw nuts 17,18 of which one screw nut 17 is located on the underside and the other screw nut 18 on the top side of the base frame bottom 12. Washers 19 are inserted between the screw nuts 17, 18 and the faces of the washers directed towards the base frame bottom 12 are dished, i.e. are provided each with a convex spherical surface 20.

The adjusting means 3, i.e. the threaded bolts 14, screw nuts 17, 18 and washers 19 permit an exact setting of the height of base frame 2. However, it is also possible to set in jamming-free manner a particular slope or inclination of base frame 2 by the spherical surfaces 20 of washers 19 and the portions of bores 13 of base frame 2 extending to either end of bore 13. At the upper end of the threaded bolt 14 can be provided a hexagonal recess, a cross-slot 21 or a slit for tightening the threaded bolt 14 using a corresponding wrench or screwdriver. However, the upper end 22 can also be constructed as an external hexagon.

The manhole covering shown in FIG. 3 has the same adjusting means 3 as the manhole covering according to FIG. 1, and the selected reference numerals denote the same elements as in FIG. 1. The fixing of the threaded bolts 14 in base frame 2 also takes place in the same way as in FIG. 1. In the partial view of FIG. 2A, is shown a modified fixing of the threaded bolts 14. Such fixing is carried out by means of a support 16', e.g. a shoulder, an adjusting ring or a lock nut provided on the bolt and resting on the base part 6.

In the construction according to FIG. 3, the base frame 2 is formed of one piece which, in place of casing 1 of FIG. 1 is arranged in a frame 23, which defines the upper end of a vertical manhole 24. The frame 23 has ribs 25 positioned on the outer circumference and its manhole side end has an outer flange 26 and an inner flange 27 of greater wall thickness, and in the latter are also located the pockets 9 for fixing the threaded bolts 14.

In both cases of the manhole covering of FIG. 1 and FIG. 3, the upper edge of base frame 2 is constructed as a seat 30, in which can be inserted a non-shown manhole grating or cover.

The two described manhole coverings with an adjustable height and slope according to FIGS. 1 and 3 have a simple construction. Base frame 2 can be exactly adjusted by means of the screw nuts 17, 18, with the screw nut 18 acting as a lock nut for preventing any displacement of base frame 2 even under heavy loads and eccentric force application. This also applies to the screw connection of threaded bolt 14 in base part 6 of casing 1 or in the inner flange 27 of frame 23.

The number of threaded bolts is determined on the basis of the size of the manhole covering and the load to be received. The cavity below the base frame 2 can optionally be mortared, but this is not necessary.

Due to the fact that the base frame 2 is arranged in casing 1, the latter can be laid alone and the base frame 2 subsequently inserted, which facilitates the laying of the manhole covering in the ground.

What is claimed is:

1. Manhole covering for sewers, gullies and water intakes and which is laid on an upper end of a vertical manhole, the covering comprising a casing embedded in the ground, a base frame for mounting a manhole cover, said casing including a peripheral wall part and a bottom wall part inwardly extending from said peripheral wall part, and adjusting means provided on said base frame to enable an adjustment of the base frame in height and slope in respect to said casing, the base frame including bores and being inserted in said casing, said adjusting means including at least three threaded bolts traversing the base frame and extending through said bores and being spaced from each other on the base frame, said bolts having support means which fixedly support the bolts in the casing and each carrying a pair of threaded nuts which positively position and secure the base frame at a top and a bottom thereof, said adjusting means further including one-piece washers inserted between said threaded nuts and said base frame and each having convexly curved external surfaces, said bores having sloped surfaces widening towards two opposing open ends of each bore and cooperating with and supporting said convexly curved external surfaces of said washers, said bottom wall part being provided with pockets each receiving a lower end of an associated threaded bolt, said bottom part being provided in a portion thereof above each pocket with an open slit to allow said lower end to pass therethrough.

2. Manhole covering according to claim 1, wherein the lower end of the threaded bolt is provided with a support to secure the lower end together with the screw nut.

3. Manhole covering according to claim 1, wherein the lower end of the threaded bolt is provided with an adjusting ring to secure the lower end together with the screw nut.

4. Manhole covering according to claim 1, wherein the lower end of the threaded bolt is provided with a lock nut to secure the lower end together with the screw nut.

5. Manhole covering according to claim 1, wherein each of said bores is formed in a bottom of said frame.

* * * * *